United States Patent [19]

Simons

[11] Patent Number: 4,977,963

[45] Date of Patent: Dec. 18, 1990

[54] PARTIALLY CONCEALED FAST RESPONSE SPRINKLER HEAD

[75] Inventor: John R. Simons, Greendale, Wis.

[73] Assignee: Star Sprinkler Corporation, Milwaukee, Wis.

[21] Appl. No.: 335,749

[22] Filed: Apr. 10, 1989

[51] Int. Cl.[5] ..... A62C 37/08

[52] U.S. Cl. ..... 169/37; 169/42; 169/40

[58] Field of Search ..... 169/42, 37, 40, 38, 169/39, 41

[56] References Cited

U.S. PATENT DOCUMENTS

| | | | |
|---|---|---|---|
| 2,389,334 | 11/1945 | Tyden | 169/40 |
| 2,591,872 | 8/1952 | Rider | 169/40 |
| 3,130,790 | 8/1964 | Hodgman, Jr. | 169/40 |
| 3,195,647 | 7/1965 | Campbell et al. | 169/40 |
| 3,459,266 | 8/1969 | Ault | 169/37 |
| 4,014,388 | 3/1977 | Anderson | 169/37 |
| 4,015,665 | 4/1977 | Simons et al. | 169/40 |
| 4,066,129 | 1/1978 | Anderson | 169/37 |
| 4,105,076 | 8/1978 | Simons et al. | 169/40 |
| 4,376,465 | 3/1983 | Simons et al. | 169/39 |
| 4,491,182 | 1/1985 | Pieczykolan | 169/38 |
| 4,508,175 | 4/1985 | Pieczykolan | 169/38 |
| 4,618,002 | 10/1986 | Mears | 169/37 |
| 4,662,455 | 5/1987 | Simons | 169/37 |
| 4,757,865 | 7/1988 | Simons | 169/39 |
| 4,766,961 | 8/1988 | Macie | 169/38 |

*Primary Examiner*—Joseph F. Peters, Jr.
*Assistant Examiner*—Christopher P. Ellis
*Attorney, Agent, or Firm*—Andrus, Sceales, Starke & Sawall

[57] ABSTRACT

A partially concealed fast response sprinkler head having a body defining an inlet to be connected to a water line and having an outlet normally enclosed by a valve cap. The upper ends of a pair of lever members are supported on an internal shoulder in the body. Each lever member is generally semicircular in cross section and the lower ends of the lever members taper inwardly and define a central passage. The valve cap is provided with a threaded bore which receives a screw and the head of the screw engages a retaining bar, the ends of which bear against the upper ends of the respective lever members at a location spaced inwardly from the engagement of the lever members with the body, so that the force of the retaining bar against the lever members will tend to pivot the lower ends of the lever members outwardly away from each other. The retaining bar has a central opening that exposes the head of the screw and by turning out the screw from the threaded bore, a force will be applied to the lever members to urge the lever members outwardly away from each other. The lower ends of the lever members are retained together by a pair of metal heat transfer discs, which are disposed flatwise to each other and have mating open ended recesses that receive the lower ends of the lever members. A fusible metal is located at the interface between the discs. A decorative plate is removably attached to the body and the plate is urged by a spring against the ceiling. When the sprinkler head is exposed to an elevated temperature, the fusible metal will melt and the biasing action on the lever members will urge the lever members apart to release the lever members from engagement with the body and open the valve cap.

8 Claims, 2 Drawing Sheets

FIG. 3
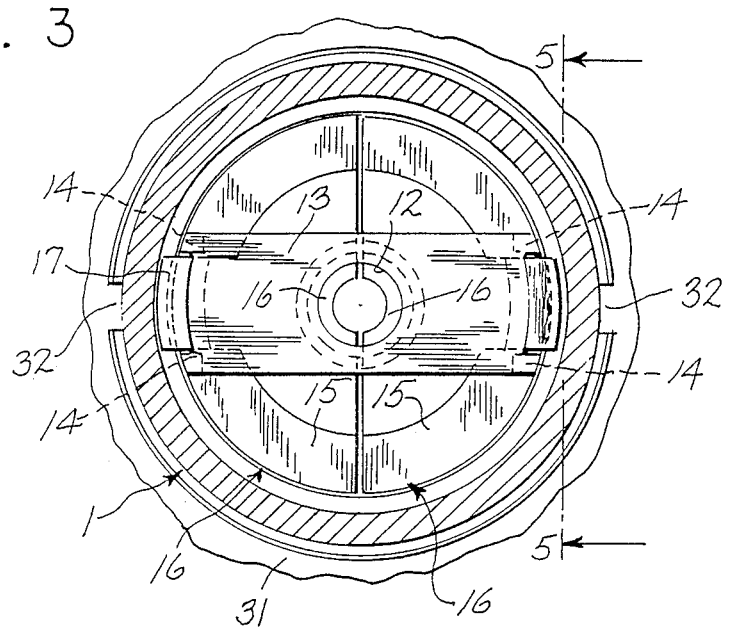
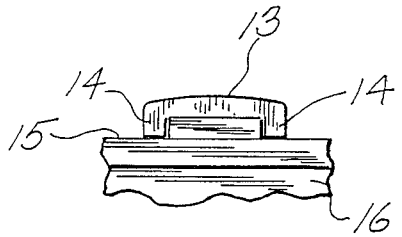
FIG. 5
FIG. 4
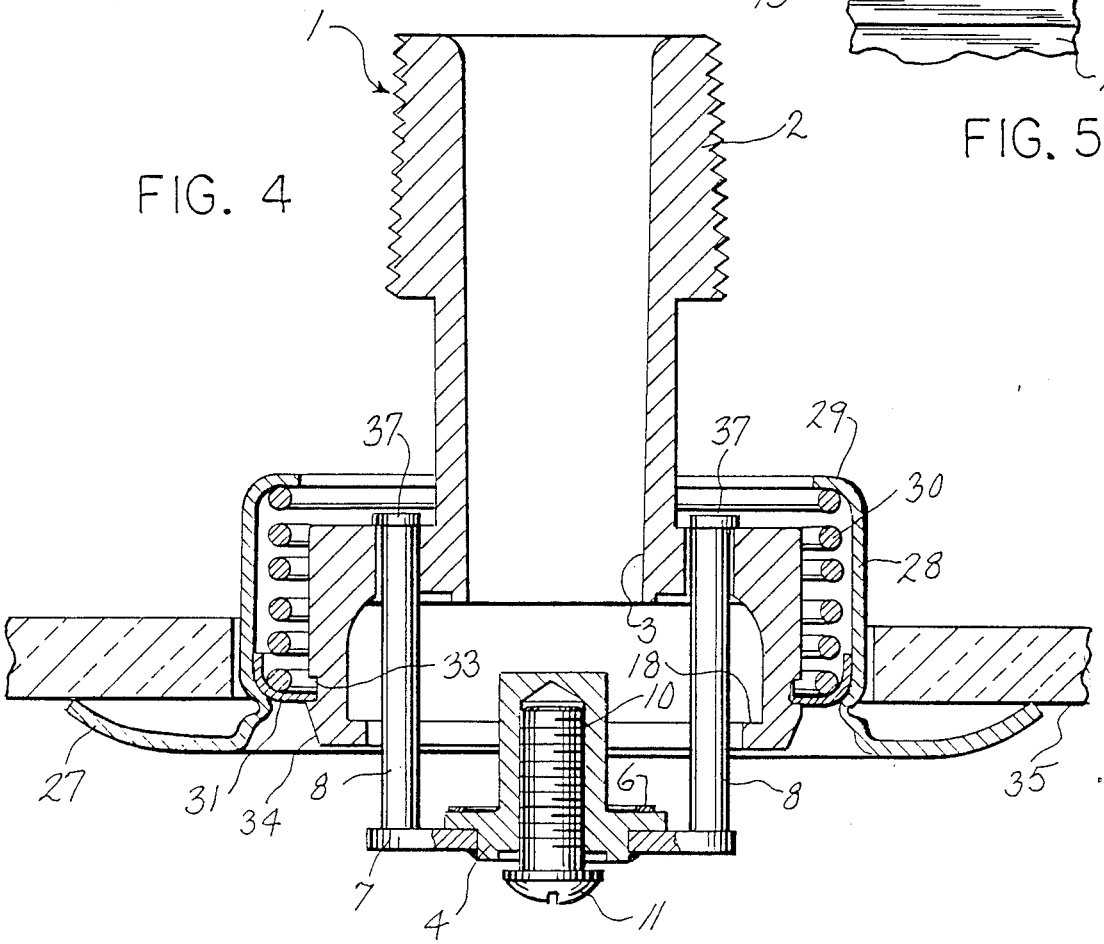

PARTIALLY CONCEALED FAST RESPONSE SPRINKLER HEAD

BACKGROUND OF THE INVENTION

A pendant-type sprinkler head is commonly used in commercial and industrial buildings. A sprinkler head of this type includes a cast metal frame having a base that defines an outlet connected to the water piping system. The frame is composed of a pair of arms that extend outwardly from the base and are connected together at a junction. The outlet in the base is normally enclosed by a cap, which is held in the closed position by a lever assembly that extends between the cap and the junction. A fusible link, including a fusible element or metal, retains the lever assembly in position to close off the outlet. On exposure to an elevated temperature, the fusible metal will melt, releasing the lever assembly to open the outlet to the water line.

With the increased use of sprinkler systems in hospitals, hotels, nursing homes and residences, where the prime object is to save human life, as opposed to property protection, there has been a demand for a faster response sprinkler head, meaning one that will release more quickly when exposed to elevated temperatures.

U.S. Pat. No. 4,757,865 discloses a fast response sprinkler head, in which the fusible link assembly includes a pair of thin metal discs or sheets which are joined together by a layer of fusible metal or solder. Each sheet is formed with mating open-ended recesses that define an opening which receives the lever members. The sheets are provided with bent tabs or fins which increase the frontal area exposed to the heat of combustion, thereby increasing the rate of heat transfer to the fusible link and achieving a faster response time. However, with the fast response sprinkler head as described in U.S. Pat. No. 4,757,865, the entire sprinkler head is located beneath the ceiling, in a position where it is exposed to view.

In residential dwellings, office buildings, hotels, and other commercial establishments, it is often desired to utilize a sprinkler head that is located above the ceiling, so that the operative parts are not exposed to view. U.S. Pat. Nos. 3,633,676, 3,714,989, 3,756,321 and 4,105,076 describe concealed sprinkler head installations, where the sprinkler head is concealed within the ceiling by a decorative plate that is mounted flush against the ceiling, so that none of the operative parts are visible.

SUMMARY OF THE INVENTION

The invention is directed to a partially concealed, fast response, sprinkler head. The sprinkler head of the invention includes a body having an inlet to be connected to the water supply system and having an outlet that is normally enclosed by a valve cap. The upper ends of a pair of lever members are supported on an internal shoulder of the body and each lever member is generally semi-circular in cross section. The lower ends of the lever members taper inwardly and the lever members, in combination, define a central passage.

A threaded bore is formed in the valve cap and receives a bolt, with the head of the bolt extending downwardly and being engaged with a retaining bar, the ends of which are in bearing engagement with the respective lever members at a location spaced inwardly from the engagement of the lever member with the valve body.

The retaining bar is provided with a hole that exposes the central portion of the bolt head and by inserting a tool through the central passage, between the lever members, the bolt can be threaded out to apply a force through the retaining bar against the lever members to thereby urge the lower ends of the lever members in a direction away from each other. The lower ends of the lever members are retained together by a pair of metal heat transfer sheets or discs which are disposed flatwise with respect to each other. The sheets are provided with mating open-ended recesses that define an opening to receive the lower ends of the lever members. A fusible material, such as solder, is located at the interface between the discs and secures the discs together to thereby prevent expansion or release of the lever members under the biasing force.

A decorative ceiling plate assembly is removably attached to the outer surface of the body and includes a decorative plate, which is urged against the ceiling by a spring.

When the sprinkler head is exposed to an elevated temperature, the fusible metal will melt and the biasing force applied to the lever members will urge the lower ends of the lever members away from each other. This pivoting action will release the upper ends of the lever members from engagement with the shoulder on the body, causing the retaining bar, lever members, and the heat transfer discs to fall to the ground. The water pressure within the line will then open the valve cap to release the water. The valve cap carries a deflector plate, which is mounted through slide rods to the valve body. The deflector plate and valve cap will drop a predetermined distance beneath the outlet and be retained in this location, so that the water being discharged from the outlet will strike the deflector plate and be deflected outwardly in the desired spray pattern.

The invention provides a fast response sprinkler head that is partially or semi-concealed within the ceiling, so that it has a more attractive appearance than conventional pendant-type, fast response sprinkler heads, which are fully exposed beneath the ceiling.

The decorative plate assembly includes a spring biasing arrangement which ensures that the decorative plate will be biased flush against the ceiling regardless of any vertical variations in position between the valve body and the ceiling.

The heat transfer discs or fins are directly exposed to the elevated temperature, and as the fusible metal is located at the interface between the heat transfer discs, a faster response is achieved over systems where the fusible metal is located internally and a complicated heat transfer system is necessary to transfer heat to the fusible metal. Thus, the invention not only provides a faster response than conventional types, but also utilizes a lesser number of operative parts.

Other objects and advantages will appear in the course of the following description.

DESCRIPTION OF THE DRAWINGS

The drawings illustrate the best mode presently contemplated of carrying out the invention.

In the drawings:

FIG. 3 is a transverse section taken along line 3—3 of FIG. 1;

FIG. 4 is a longitudial section showing the valve cap in the released position; and FIG. 5 is an enlarged section taken along line 5—5 of FIG. 3.

DESCRIPTION OF THE ILLUSTRATED EMBODIMENT

The drawings show a semi-concealed fast response sprinkler head, including a body 1 having an upper threaded end 2 that is adapted to be connected to a water piping system, not shown. The lower end of body 1 defines an outlet 3, which is normally enclosed by a valve cap 4.

Figure 1:
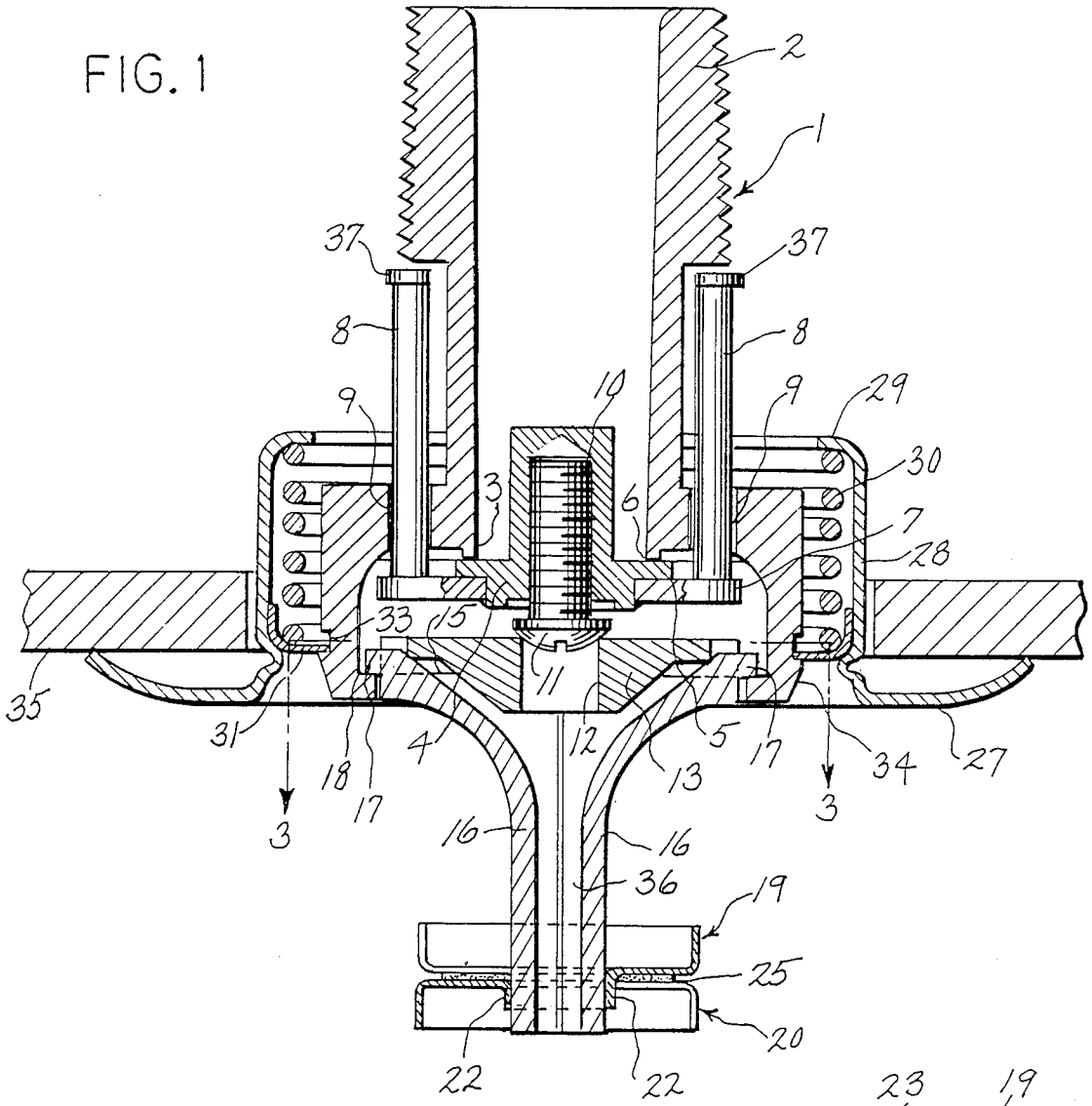
FIG. 1 is a longitudinal section of the sprinkler head of the invention.
Figure 2:
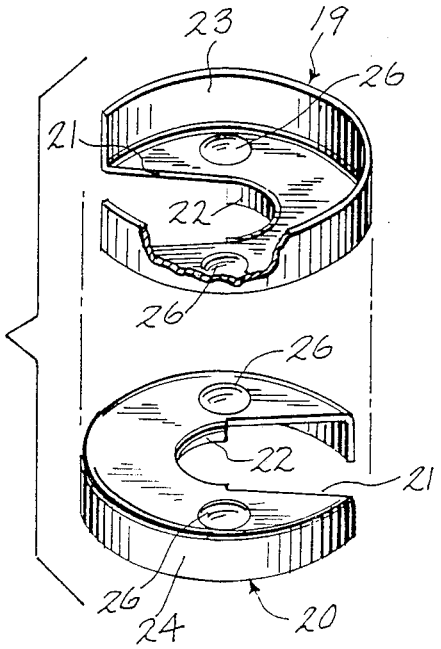
FIG. 2 is an exploded perspective view showing the heat transfer discs.

As best shown in FIG. 1, valve cap 4 is provided with an outwardly extending annular flange 5 which seats against the lower annular edge of body 1 that defines outlet 3 and a suitable gasket 6 formed of polytetrafluoroethylene, or the like, is interposed between the flange 5 and the valve body to seal the outlet.

A deflector ring 7 is secured to valve cap 4 and the deflector ring carries a pair of slide rods 8 which are mounted for sliding movement within openings 9 in body 1.

As shown in FIG. 1, the lower end of valve cap 4 is provided with a central threaded bore, which receives a screw 10. The head 11 of screw 10 is located beneath the valve cap and bears against an annular edge that borders an opening 12 in a retaining bar 13.

Opposite ends of bar 13 are provided with a pair of downwardly extending projections or feet 14 and each pair of projections 14 bears against the flat upper end 15 of a lever member 16.

As best illustrated in FIG. 3, lever members 16 are each generally semi-circular in cross section and the upper end of each lever member flares outwardly, as shown in FIG. 1. An outwardly projecting lug or ear 17 is formed at the upper end of each lever member and the lug bears against an internal annular shoulder 18 formed in body 1. Lugs 17 of lever members 16 are located diametrically opposite of each other and each lug 17 is straddled by the feet 14 at the end of bar 13. The engagement of the lug 17 with shoulder 18 provides a fulcrum for pivoting movement of the lever members 16 in a direction away from each other, as will be hereinafter described.

The lower surface of retaining bar 13 is shaped so that it is out of contact with the upper ends of the lever members 16, so that the only contact between the retaining bar 13 and lever members 16 will be through the projections 14. As a downward force is applied through projections 14 against lever members 16, the lever members will tend to pivot outwardly away from each other about the point of contact between lugs 17 and shoulder 18.

The lower ends of lever members 16 are retained in mating relationship by a pair of heat transfer discs or sheets 19 and 20 composed of metal, such as copper, or the like. Each disc 19,20 is provided with an open ended recess 21 and the recesses 21 are disposed in mating relation, and in combination define an opening which receives the lower ends of the lever members 16. Each disc 19,20 is provided with a downwardly extending flange 22, which borders the recess 21 and the flanges 22, in combination, define a generally cylindrical bearing section which engages the lever members 16.

To provide increased heat transfer, each disc 19,20 is provided with a peripheral flange 23 and 24, respectively, which extends generally normal to the body of the disc.

A layer 25 of a fusible metal or solder which will melt at a relatively low temperature is disposed at the interface between the discs 19 and 20 and thus holds the sheets together and prevents radial expansion of the lower ends of the spring biased lever members 16.

Mating dimples or depressions 26 are formed in sheets 19 and 20 and the layer 25 of fusible metal extends within the dimples. The fusible metal located within the dimples is thus subjected primarily to tension stress, as opposed to shear stress, and will aid in resisting separation of the discs 19,20.

The sprinkler head of the invention also includes a decorative plate assembly that includes an annular decorative plate 27. A cylindrical sleeve 28 extends upwardly from the inner periphal edge of plate 27 and terminates in an inwardly extending upper flange 29. Coil spring 30 is interposed between flange 29 and a retaining ring 31, which is secured to sleeve 28. Ring 31 is provided with a plurality of inwardly extending flexible tabs 32 which are engaged within a circumferential groove 33 formed in the outer surface of body 1.

Decorative plate 27, sleeve 28, spring 30 and retaining ring 31, are pre-assembled and the assembly is then slid upwardly over the body 1, after the body has been installed with the water line. Tabs 32 will ride against the tapered lower surface 34 of body 1 and snap into place in groove 33. The force of spring 30 will urge the plate 27 firmly against the lower surface of ceiling 35.

Valve body 1 is installed a precise distance from the lower surface of ceiling 35. During service there may be a variation in this critical distance due to relative movement that may occur between the water system and the ceiling. The biasing action of the decorative plate assembly of the invention ensures that the plate 27 will be maintained flush against the ceiling regardless of any vertical variations in position between the valve body and the ceiling.

At the factory, screw 10 is threaded down in the bore in valve cap 4 and the retaining bar 13 and lever members 16 are then assembled with the body. The pre-assembled heat transfer discs 19,20 with the layer of fusible metal therebetween, is then slipped upwardly over the lower ends of the lever members 16.

A tool, such as a screwdriver is then inserted in the central passage 36 between the lever members and through the opening 12 in retaining bar 13 and into engagement with screw 10. By turning the screw out, the head of the screw applies a downward force against the retaining bar 13 which, in turn, applies a force through projections 14 to the lever members 16 at a location disposed inwardly of the fulcrum, with the result that the lower ends of the lever members are urged outwardly into tight engagement with the heat transfer discs 19,20.

At the site of the installation, the body 1 is threaded to the water line and the decorative plate assembly is then installed with the body, with the tabs 32 of retaining ring 31 riding up the tapered surface 34 and engaging the groove 33. The force of the spring 30 will then urge the plate 27 into tight engagement with the lower surface of ceiling 35.

When the sprinkler head is exposed to an elevated temperature, the layer 25 of fusible metal or solder will melt, and the outward biasing force being applied to the lever members 16 will separate the heat transfer discs 19 and 20. The lever members 16 will then pivot about the engagement of lugs 17 with shoulder 18 to disengage the lugs from the shoulder and enable the lever members 16, as well as the retaining bar 13 and discs 19 and 20 to drop to the floor. The water pressure in the line will then act to open the valve cap 4 and the valve cap and deflector ring 7 will be forced downwardly by the water pressure until the collars or stops 37 on the upper ends of the slide rods 8 engage the body. The deflector ring 7 and cap 4 will then be held in a predetermined location spaced beneath the outlet 3 and the water being discharged from the outlet will strike the deflector 7 and be deflected outwardly in the desired spray pattern.

The invention provides a fast response sprinkler head that is partially concealed within the ceiling and thus provides a more attractive appearance than conventional pendant-type fast response sprinkler heads. The heat transfer discs 19,20 are directly exposed to the heat of combustion, so that the heat will be more readily transferred to the fusible metal. This is an improvement over conventional fast response sprinklers, in which the fusible metal normally is located in an internal position and complicated heat transfer systems are utilized to transfer heat to the fusible metal.

Various modes of carrying out the invention are contemplated as being within the scope of the following claims particularly pointing out and distinctly claiming the subject matter which is regarded as the invention.

I claim:

1. A partially concealed fast response sprinkler head, comprising a body having an inlet to be connected to a water line and having an outlet, valve means to enclose said outlet, a pair of lever members each having an upper end supported on said body, connecting means interconnecting the valve means and said lever members for urging the lower ends of said lever members in a direction away from each other, a pair of heat transfer members interconnecting the lower ends of said lever members, and fusible metal means interconnecting said heat transfer members, said heat transfer members comprising a pair of thin metal discs disposed in flatwise relation, said fusible metal means being disposed between said discs, said discs having mating open-ended recesses that define an aperture and the lower ends of said lever members are received within said aperture, said fusible metal means being constructed and arranged to melt when exposed to an elevated temperature to release engagement of said heat transfer members and cause disengagement of said lever members from said body to thereby open said valve means.

2. The sprinkler head of claim 1, wherein each disc has a generally curved flange bordering the respective recess, said flanges in combination defining said aperture.

3. The sprinkler head of claim 2, and including a peripheral fin disposed on at least one of said discs and extending at an angle to said disc.

4. The sprinkler head of claim 1, wherein said discs have mating dimples, said fusible metal means extending between said mating dimples.

5. A partially concealed fast response sprinkler head, comprising a body having an inlet to be connected to a water line and having an outlet, valve means to enclose said outlet, a pair of lever members each having an upper end supported on said body, connecting means interconnecting the valve means and said lever members for urging the lower ends of said lever members in a direction away from each other, a pair of thin metal members disposed flatwise with respect to each other, said metal members having open ended recesses defining an aperture to receive the lower end of said lever members, each metal member having a generally curved flange bordering the recess, said flanges in combination defining said aperture, and a layer of a fusible metal disposed between said metal members.

6. The sprinkler head of claim 5, wherein said metal members are composed of copper.

7. The sprinkler head of claim 5, wherein said metal members are provided with mating dimples and said fusible metal extends within said dimples.

8. A partially concealed fast response sprinkler head, comprising a body having an inlet to be connected to a water line and having an outlet, valve means to enclose said outlet, said body having an internal shoulder, a pair of lever members each having an upper end supported on said internal shoulder, each lever member being generally semi-circular in cross section and the lower ends of said members being in mating relation to define a passage therebetween, connecting means interconnecting said valve means and said lever members for urging the lower ends of the lever members in a direction away from each other, releasable means including a mass of fusible metal interconnecting said lower ends and preventing movement of said lower ends in said direction, adjustable means disposed coaxially of said valve means and extending downwardly therefrom, said adjustable means being mounted for axial movement relative to said valve means, the lower end of said adjustable means being disposed in engagement with said connecting means whereby downward movement of said adjusting means exerts a force through said connecting means against said lever members to urge said lever members in said direction, said connecting means having an opening aligned with the passage between said lever members and said adjustable means being exposed through said passage, whereby a tool can be inserted through said passage and through said opening and into engagement with said adjustable means, exposure of said fusible metal to an elevated temperature acting to melt said metal and release said releasable means to thereby disengage said lever members from said body and open said valve means.

* * * * *